US007140899B2

(12) United States Patent
Matsunaga

(10) Patent No.: US 7,140,899 B2
(45) Date of Patent: Nov. 28, 2006

(54) CONNECTOR EASILY ENABLING ELECTRICAL INSPECTION OF CONTACTS

(75) Inventor: Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/237,018

(22) Filed: Sep. 28, 2005

(65) Prior Publication Data

US 2006/0068627 A1 Mar. 30, 2006

(30) Foreign Application Priority Data

Sep. 30, 2004 (JP) ..... 2004-285992

(51) Int. Cl.
*H01R 13/62* (2006.01)

(52) U.S. Cl. ..... 439/326; 439/912

(58) Field of Classification Search ..... 439/331, 439/326, 912, 910, 630, 911, 325
See application file for complete search history.

(56) References Cited

U.S. PATENT DOCUMENTS 3,825,878 A * 7/1974 Finger et al. ..... 439/493
6,149,466 A * 11/2000 Bricaud et al. ..... 439/630
6,383,027 B1 * 5/2002 Cabane et al. ..... 439/630

FOREIGN PATENT DOCUMENTS

JP 2000-340280 A 12/2000
JP 2004-146166 * 5/2004

* cited by examiner

*Primary Examiner*—Phuong Dinh
(74) *Attorney, Agent, or Firm*—Frishauf, Holtz, Goodman & Chick, P.C.

(57) ABSTRACT

In a connector for connection to a connection object, a plurality of contacts are arranged in a first direction in the connector body and comprises contact portions and retaining portions, respectively. Each of the contact portions is adapted to be connected to the connection object. The connector body retains the retaining portions. A cover is coupled to the connector body and adapted to push the connection object toward the contact portions in a second direction perpendicular to the first direction. The retaining portions have inspection exposure portions at positions, respectively, that face the cover in the second direction. Adjacent ones in the first direction of the inspection exposure portions are offset in position from each other in a third direction perpendicular to the first and second directions.

8 Claims, 4 Drawing Sheets

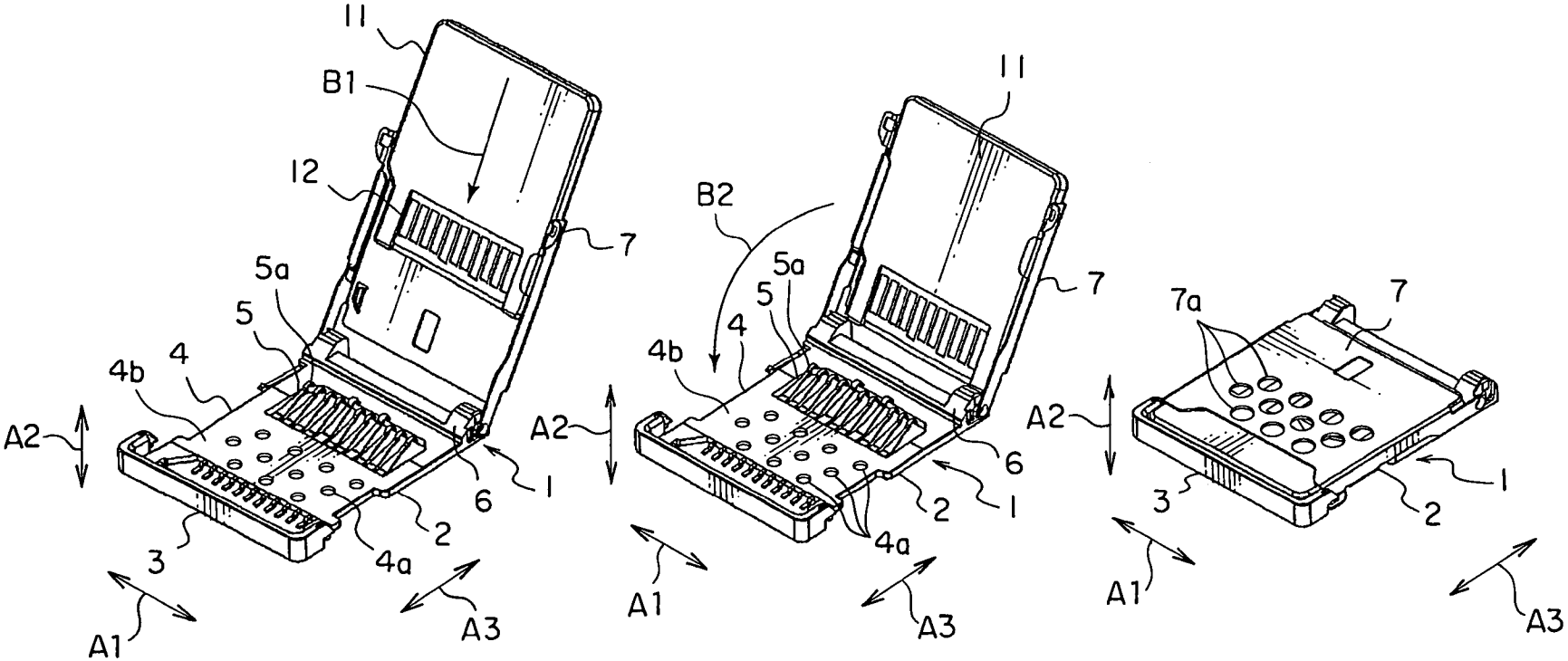
FIG. IC
FIG. IB
FIG. IA

CONNECTOR EASILY ENABLING ELECTRICAL INSPECTION OF CONTACTS

This application claims priority to prior Japanese patent application JP2004-285992, the disclosure of which is incorporated herein by reference.

BACKGROUND OF THE INVENTION

This invention relates to a connector for connecting a connection object such as an IC card and, in particular, relates to a connector that enables electrical inspection of contacts.

One example of a connector of this type is disclosed in JP-A-2004-146166. In the disclosed connector, seven contacts are arranged in a row and retained in a resin housing. The housing is formed with seven circular small holes arranged in a row so as to correspond to the contacts, respectively.

According to this structure, continuity of each contact can be checked by contacting a probe pin with the corresponding contact through the corresponding small hole.

However, since the small holes are formed so as to be arranged in the row, each hole is limited to a small size and therefore the electrical inspection of the contacts is not easy. Particularly, it is difficult to deal with a connector having contacts that are arranged at a narrow pitch.

Another example of a connector of this type is disclosed in JP-A-2000-340280. In the disclosed connector, several contacts are arranged in a row in a predetermined direction and retained in a housing. A metal cover is attached to the housing so as to be rotatable about a rotation shaft. The cover is adapted to cover a card received in the housing. The cover has elongated holes formed at two portions thereof and each extending in the predetermine direction.

According to this structure, continuity of each contact can be checked by contacting a probe with the corresponding contact through the elongated hole.

However, since the elongated holes formed in the cover are each large in size, the electromagnetic shielding operation of the cover is largely impeded.

SUMMARY OF THE INVENTION

It is therefore an object of this invention to provide a connector that easily enables electrical inspection of contacts without adversely affecting the electromagnetic shielding operation of a cover.

It is another object of this invention to provide a connector that easily enables electrical inspection of contacts even when the contacts are arranged at a narrow pitch.

Other objects of the present invention will become clear as the description proceeds.

According to an aspect of the present invention, there is provided a connector for connection to a connection object, the connector comprising a connector body, a plurality of contacts arranged in a first direction in the connector body and comprising contact portions and retaining portions, respectively, each of the contact portions being adapted to be connected to the connection object, each of the retaining portions being retained by the connector body, and a cover coupled to the connector body and adapted to push the connection object toward the contact portions in a second direction perpendicular to the first direction, the retaining portions having inspection exposure portions at positions, respectively, that face the cover in the second direction, adjacent ones in the first direction of the inspection exposure portions being offset in position from each other in a third direction perpendicular to the first and second directions.

BRIEF DESCRIPTION OF THE DRAWINGS

FIG. 1A is a perspective view showing the state where a cover of a connector according to an embodiment of this invention is opened and an IC card is on the way to be inserted into the cover;

FIG. 1B is a perspective view showing the state where the cover of the connector is opened and the IC card is inserted in the cover;

FIG. 1C is a perspective view showing the state where the IC card is connected to the connector;

DESCRIPTION OF THE PREFERRED EMBODIMENT

Figure 2A:
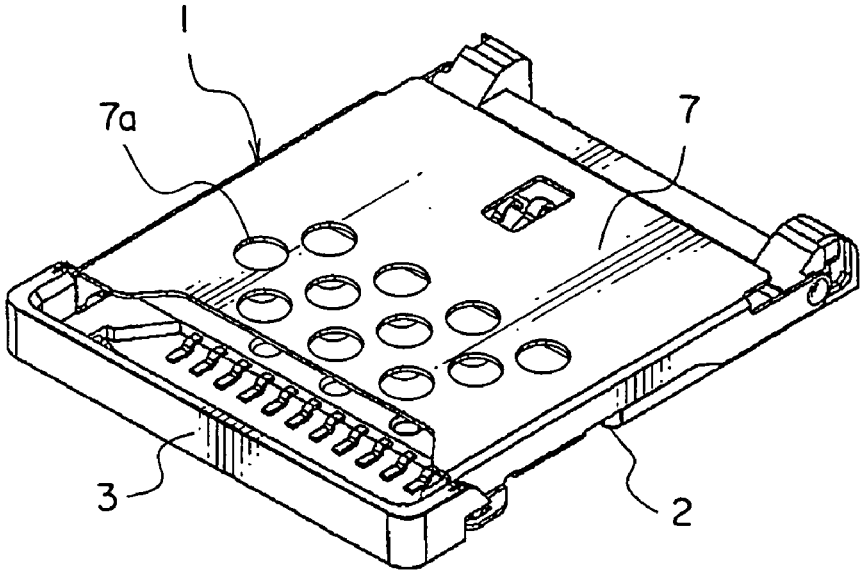
FIG. 2A is a perspective view as seen from a front side of the connector.

Referring to FIGS. 1A and 1B, description will be made about an outline of a connector according to an embodiment of this invention.

The shown connector 1 is adapted for connection of an IC card 11, i.e. a connection object, and comprises a connector body 2. The connector body 2 comprises a frame 3 and a flat-plate insulator 4 provided in the frame 3. The insulator 4 retains eleven conductive contacts 5 arranged in a row in a first direction A1 at a constant pitch.

Inspection hole portions 4*a* are formed through the insulator 4 at eleven portions thereof in one-to-one correspondence with the contacts 5. The inspection hole portions 4*a* are arranged so as to be divided into three rows in a third direction A3 perpendicular to the first direction A1 and a second direction A2. Therefore, the inspection hole portions 4*a* that are adjacent to each other in the first direction A1 are offset in position from each other in the third direction A3.

Each contact 5 has a contact portion 5*a* movable in the second direction A2 perpendicular to the first direction A1. The contact portion 5*a* projects upward from a main surface 4*b* of the insulator 4 in the second direction A2.

A pair of hinges 6 are provided on one end side of the frame 3 in the third direction A3. By these hinges 6, a metal cover 7 is rotatably attached to the connector body 2. Therefore, the cover 7 can be opened and closed with respect to the connector body 2.

The IC card 11 is inserted inside the cover 7 in a direction of arrow B1 in FIG. 1A. The IC card 11 has eleven card pad portions (a card electrical contact group) 12 arranged in a row in the first direction A1 at a constant pitch. In the state of FIG. 1B where the IC card 11 is received inside the cover 7, when the cover 7 is rotated about the pair of hinges 6 as fulcrums in a direction of arrow B2 with respect to the connector body 2, a connected state of FIG. 1C is reached. In this connected state, the cover 7 pushes the card pad portions 12 of the IC card 11 toward the contact portions 5*a* of the contacts 5 in the second direction A2, respectively.

The cover 7 has a plurality of through holes 7*a* that correspond to the inspection hole portions 4*a*, respectively. Each through hole 7*a* is formed at a position that faces the corresponding inspection hole portion 4*a* in the second direction when the cover 7 is closed. Each through hole 7*a* has a diameter greater than that of the corresponding inspection hole portion 4*a*.

Figure 2B:
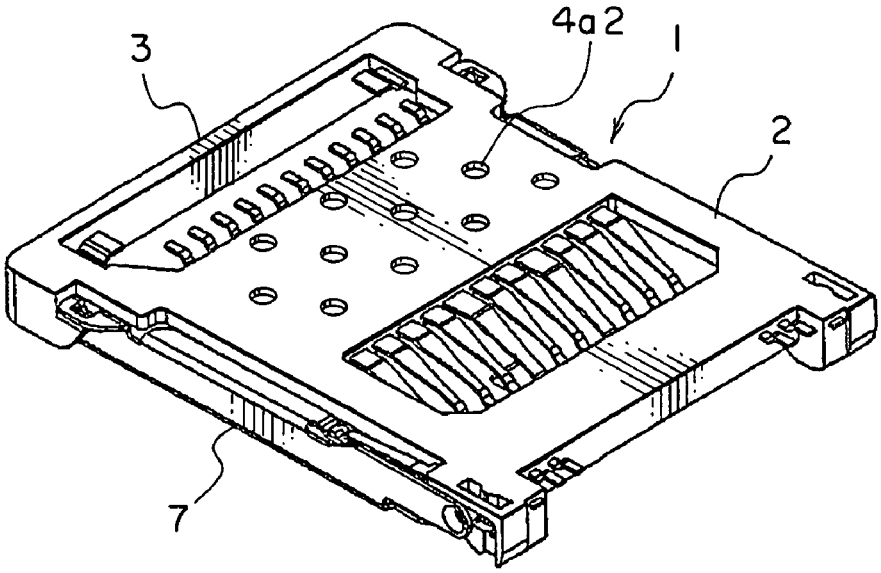
FIG. 2B is a perspective view as seen from a bottom side of the connector.
Figures 3A, 3B:
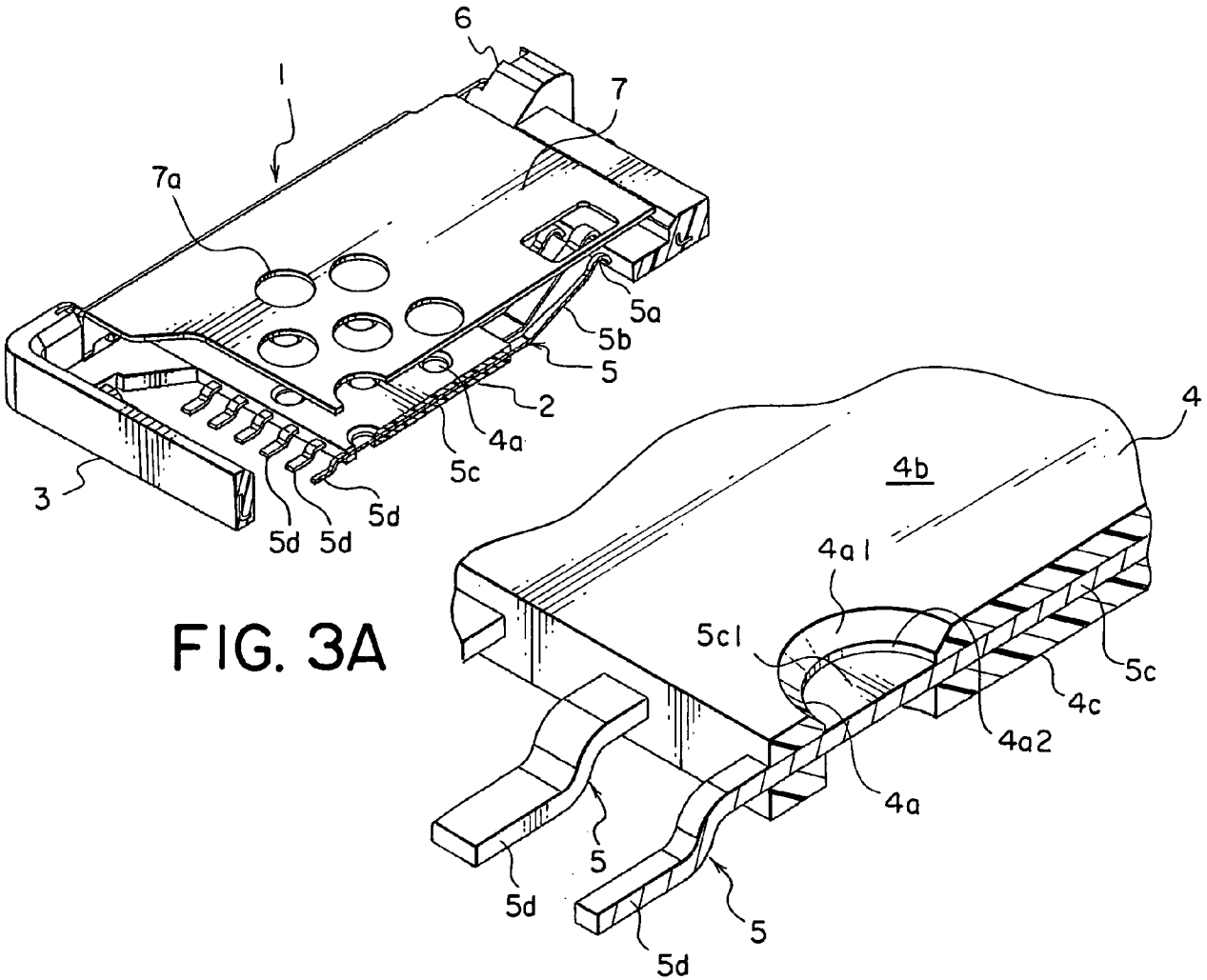
FIG. 3A is a perspective sectional view of FIG. 2A.
FIG. 3B is an enlarged view of the main part in FIG. 3A.
Figure 4A:
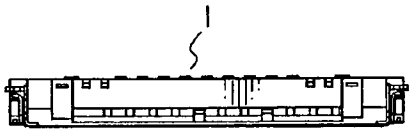
FIG. 4A is a plan view of the connector.
Figure 4B:
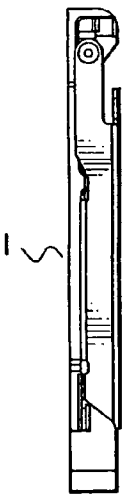
FIG. 4B is a left side view of the connector.
Figure 4C:
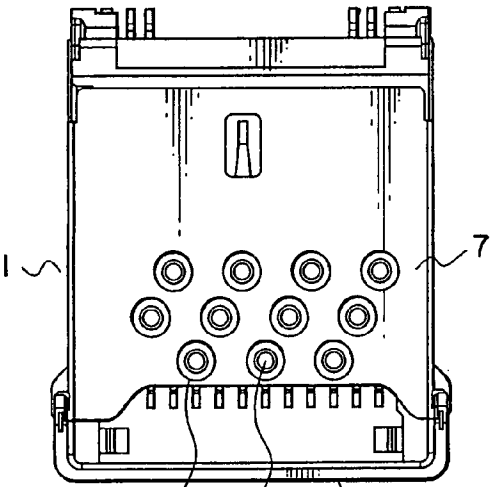
FIG. 4C is a front view of the connector.
Figure 4D:
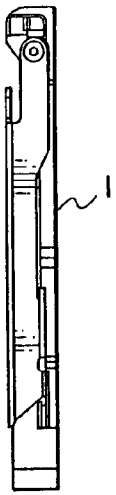
FIG. 4D is a right side view of the connector.
Figure 4E:
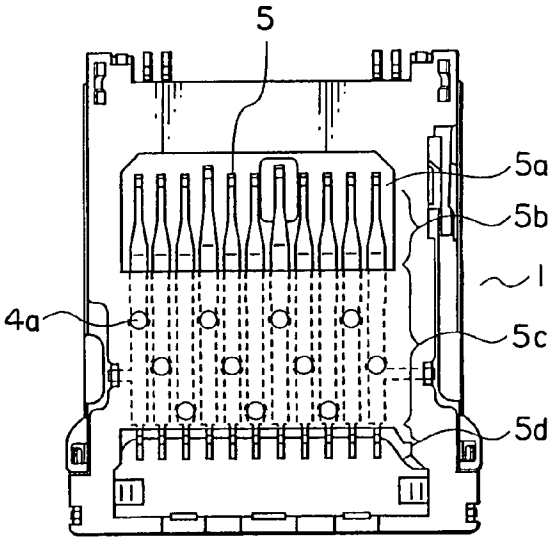
FIG. 4E is a rear view of the connector.
Figure 4F:
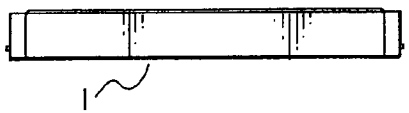
FIG. 4F is a bottom view of the connector.

Referring also to FIGS. 2A to 4F, the foregoing connector 1 will be described in detail.

Each contact 5 comprises, in addition to the foregoing contact portion 5*a*, a spring portion 5*b* for elastically contacting the contact portion 5*a* with the corresponding card pad portion 12 of the IC card 11, a retaining portion 5*c* that is retained by the insulator 4, and a connecting portion 5*d* for connection to a board or the like, which are formed continuous and integral with each other.

Each inspection hole portion 4*a* has a circular cross-section and comprises a truncated conical portion 4*a*1 having a large-diameter end open to the main surface 4*b* of the insulator 4, and a cylindrical portion 4*a*2 extending from a small-diameter end of the truncated conical portion 4*a*1 and open to an opposite surface 4*c* of the insulator 4. The retaining portion 5*c* of each contact 5 extends in the third direction A3 to pass between the main surface 4*b* and the opposite surface 4*c* of the insulator 4 and across the cylindrical portion 4*a*2 of the inspection hole portion 4*a*. As a result, part of each contact 5 is exposed to the exterior as an inspection exposure portion 5*c*1 through the corresponding inspection hole portion 4*a*. Therefore, the inspection exposure portions 5*c*1 adjacent to each other in the first direction A1 are also offset in position from each other in the third direction A3.

Each contact 5 is elongated as a whole, but a portion thereof corresponding to the inspection exposure portion 5*c*1 is designed to be wider than the diameter of the inspection hole portion 4*a*. Therefore, it can be said that each inspection hole portion 4*a* is in a state of being closed at its intermediate portion or at its one end by the corresponding inspection exposure portion 5*c*1.

Now, description will be made about electrical inspection of the foregoing connector 1.

The cover 7 is closed without loading the IC card 11. In this state, a well-known probe pin (not shown) is inserted into one of the through holes 7*a* of the cover 7. Further, a tip portion of the probe pin is inserted into the corresponding inspection hole portion 4*a* of the insulator 4 so as to be brought into contact with the corresponding inspection exposure portion 5*c*1. By carrying out this operation for the inspection exposure portion 5*c*1 of each contact 5, it is possible to perform electrical inspection of all the contacts 5 of the connector 1 according to the well-known technique.

According to the foregoing connector 1, the probe pin can be easily inserted into each inspection hole portion 4*a* while being guided by its truncated conical portion 4*a*1. Further, since the inspection exposure portion 5*c*1 of each contact 5 is formed wide, the probe pin can be reliably brought into contact with each contact 5 so that the stability of the contact is improved. Moreover, since each inspection hole portion 4*a* can be designed to be small, the electromagnetic shielding operation of the cover 7 is not impeded. Further, since the inspection hole portions 4*a* that are adjacent to each other in the first direction A1 are offset in position from each other in the third direction A3, it is possible to cope with narrowing of the pitch of the contacts 5. In addition, since the inspection hole portions 4*a* each can be designed to have the same diameter as conventional even when the pitch is narrowed, it is possible to use an existing probe pin for the continuity test.

When the cover 7 is opened, the tip portion of the probe pin can be directly inserted into each inspection hole portion 4*a* of the insulator 4 so as to be brought into contact with the corresponding inspection exposure portion 5*c*1. Even in the IC card connected state where the cover 7 is closed with the IC card 11 loaded, the tip portion of the probe pin can be inserted into each inspection hole portion 4*a* from the opposite surface 4*c* of the insulator 4 so as to be brought into contact with the corresponding inspection exposure portion 5*c*1.

While the present invention has thus far been described in connection with a single embodiment thereof, it will readily be possible for those skilled in the art to put this invention into practice in various other manners. For example, although the cover 7 is rotatable with respect to the connector body 2 in this embodiment, it is possible to change the design so that the cover 7 is stationary with respect to the connector body 2.

What is claimed is:

1. A connector for connection to a connection object, said connector comprising:

a connector body;

a plurality of contacts arranged in a first direction in said connector body, each of said contacts comprising a contact portion to be connected to said connection object, and a retaining portion that is retained by said connector body; and a cover coupled to said connector body and adapted to push said connection object toward said contact portions in a second direction perpendicular to said first direction, wherein said retaining portions have respective inspection exposure portions at positions that face said cover in said second direction, and said inspection exposure portions are arranged in a plurality of rows that are spaced apart from each other in a third direction perpendicular to said first and second directions;

wherein the inspection exposure portions in each of said rows are offset in said first direction with respect to the inspection exposure portions in each adjacent row;

wherein said connector body comprises an insulator which retains said contacts, and which comprises a main surface to face said connection object and a plurality of inspection hole portions that have respective open ends at the main surface and extend in said insulator in said second direction, and the plurality of inspection hole portions correspond respectively to the plurality of inspection exposure portions;

wherein each of said inspection hole portions comprises a truncated conical portion having a large-diameter end opened at said main surface; and wherein said cover includes a plurality of through holes corresponding respectively to said inspection exposure portions, and each of said through holes has a diameter greater than a diameter of a corresponding one of said inspection hole portions.

2. The connector according to claim 1, wherein said through holes are located at positions that face said inspection exposure portions in said second direction, respectively.

3. The connector according to claim 1, wherein each of said inspection hole portions is circular in cross-section.

4. The connector according to claim 1, wherein each of said inspection hole portions further comprises a cylindrical portion extending from a small-diameter end of said truncated conical portion to said inspection exposure portion.

5. The connector according to claim 1, wherein a second end of each of said inspection hole portions is closed by a corresponding one of said inspection exposure portions.

6. The connector according to claim 1, wherein said insulator has an opposite surface on a side opposite to said main surface, each of said inspection hole portions has another end opened at said opposite surface, and each of said retaining portions extends in said insulator so as to pass between said main surface and said opposite surface and across each of said inspection hole portions.

7. The connector according to claim 1, wherein said cover is rotatably attached to said connector body at an end thereof in said third direction.

8. The connector according to claim 1, wherein said contact portions project from said main surface of said insulator in said second direction.

* * * * *